United States Patent [19]

Gessler et al.

[11] Patent Number: 4,915,589

[45] Date of Patent: Apr. 10, 1990

[54] RUNNER WITH MECHANICAL COUPLING

[75] Inventors: Herbert Gessler, Dietratried; Helmut Kölker, Munich, both of Fed. Rep. of Germany

[73] Assignee: Elektroschmelzwerk Kempten GmbH, Munich, Fed. Rep. of Germany

[21] Appl. No.: 348,281

[22] Filed: May 5, 1989

[30] Foreign Application Priority Data

May 17, 1988 [DE] Fed. Rep. of Germany ..... 3816796

[51] Int. Cl.[4] ..... F01D 5/28

[52] U.S. Cl. ..... 416/241 B; 416/244 A; 415/217.1

[58] Field of Search ..... 415/217.1, 143; 416/241 B, 175 R, 244 A, 199

[56] References Cited

U.S. PATENT DOCUMENTS

| | | | |
|---|---|---|---|
| 4,396,445 | 8/1983 | Sasaki et al. | 416/241 B |
| 4,424,003 | 1/1984 | Brobeck | 416/241 B |
| 4,697,325 | 10/1987 | Kamigaito et al. | 416/244 A X |
| 4,784,574 | 11/1988 | Tsuno et al. | 416/241 B |
| 4,798,493 | 1/1989 | Oda et al. | 416/241 B |

FOREIGN PATENT DOCUMENTS

| | | | |
|---|---|---|---|
| 3532348 | 3/1986 | Fed. Rep. of Germany | 416/241 B |
| 178803 | 10/1983 | Japan | 416/241 B |
| 217702 | 12/1983 | Japan | 416/241 B |
| 220901 | 12/1983 | Japan | 416/241 B |
| 128901 | 7/1984 | Japan | 416/241 B |
| 8410 | 1/1986 | Japan | 416/241 B |

OTHER PUBLICATIONS

Fortschrittsberichte der Deutschen Keramischen Gesellschaft (1986/87).

*Primary Examiner*—Everette A. Powell, Jr.
*Attorney, Agent, or Firm*—Burgess, Ryan and Wayne.

[57] ABSTRACT

A runner is provided which consists of a radial turbine ceramic rotor with an integrated ceramic shaft and a non-ceramic compressor impeller which are connected by a releasable, thermally and mechanically loadable mechanical coupling in such a way that the releasable mechanical coupling is located with the compressor impeller. This coupling consists of a cylindrical slotted sleeve which, on the one hand, is fitted into a cylindrical fitting bore in the compressor impeller and, on the other hand, accepts the end of the ceramic shaft in a fitting bore. In addition, the coupling has a tie rod with a screw thread and a pair of conical clamping elements between the cylindrical sleeve and the compressor impeller.

4 Claims, 5 Drawing Sheets

RUNNER WITH MECHANICAL COUPLING

FIELD OF THE INVENTION

This invention relates in general to a runner with mechanical coupling. In one aspect, this invention relates to a runner comprised of both ceramic and non-ceramic components. In a further aspect, the invention is directed to a radial turbine ceramic rotor with an integrated ceramic shaft and a non-ceramic compressor impeller connected to the shaft by a releasable mechanical coupling.

BACKGROUND OF THE INVENTION

In the field of vehicle manufacture, the replacement of certain metal components by ceramic components is becoming increasingly important and the non-oxidic, ceramic materials of silicon nitride and silicon carbide have, for example, proven successful. The particular fields of application for ceramic components are gas turbines and exhaust gas turbocharger rotors for diesel engines and spark-ignition engines.

In a runner, which consists of both ceramic and non-ceramic components—a ceramic rotor with an integrated ceramic shaft and a non-ceramic compressor impeller, for example—the type of connection between the components in the different materials (shaft/compressor impeller) is critical. This connection must be able to resist high thermal and mechanical loads when the ceramic rotor is put into rotation by the exhaust gas energy from the engine, rotational speeds of more than 140,000 rpm and temperatures of more than 1,000° C. being reached; the rotation is transferred to the compressor impeller, which forces the air under increased pressure into the combustion chamber.

Known jointing techniques for ceramic/metal connections, such as brazing, bonding or shrinking, which have already proven themselves as permanent connections between rotor blades and the rotor disk or between the rotor disk and the rotor shaft (see DE-C No. 28 22 627 and J. E. Siebels in "Fortschrittsberichte der Deutschen Keramischen Gesellschaft", Volume 2 (1986/7), No. 1, pp 277–293) cannot be used for the application envisaged because it must be possible to release the connection between the shaft and the compressor impeller to facilitate repair.

Releasable screw threads, however, cannot be used on ceramic components because of the brittleness of the material or, alternatively, they can only be used by means of additional metallizing, which is not only expensive but also, because of the radial space requirement of the metal layer, it reduces its strength and forces a reduction in the diameter of the ceramic shaft.

Accordingly, one or more of the following objects will be achieved by the practice of the invention.

It is an object of this invention to provide a runner with mechanical coupling which is comprised of both ceramic and non-ceramic components.

Another object of the invention is to provide a runner, which consists of a radial turbine ceramic rotor with an integrated ceramic shaft and a non-ceramic compressor impeller, a thermally and mechanically loadable connection, which can be released if required.

These and other objects will readily become apparent to those skilled in the art in light of the teachings herein set forth.

SUMMARY OF THE INVENTION

In its broad aspect, the present invention is directed to a radial turbine ceramic rotor with an integrated ceramic shaft and a non-ceramic compressor impeller connected to the shaft by a releasable mechanical coupling. The ceramic shaft is connected to the non-ceramic compressor impeller by means of a releasable mechanical coupling such that the releasable mechanical coupling is located within the compressor impeller.

BRIEF DESCRIPTION OF THE DRAWINGS

The invention will be more readily understood by reference to the drawings, wherein.

DETAILED DESCRIPTION OF THE INVENTION

The coupling of the present invention consists of a cylindrical, slotted sleeve which, on the one hand, is fitted into a cylindrical fitting bore in the compressor impeller and, on the other hand, accepts the end of the ceramic shaft in a fitting bore. In addition, the coupling has a tie rod with a screw thread and a pair of conical clamping elements between the cylindrical sleeve and the compressor impeller.

The pair of conical clamping elements is preferably located by a distance ring in the central clamping region. As an alternative, however, only one conical clamping element can be present, this element either matching a conical bush cast into the compressor impeller or directly matching a conical bore in the compressor impeller.

Figure 1:
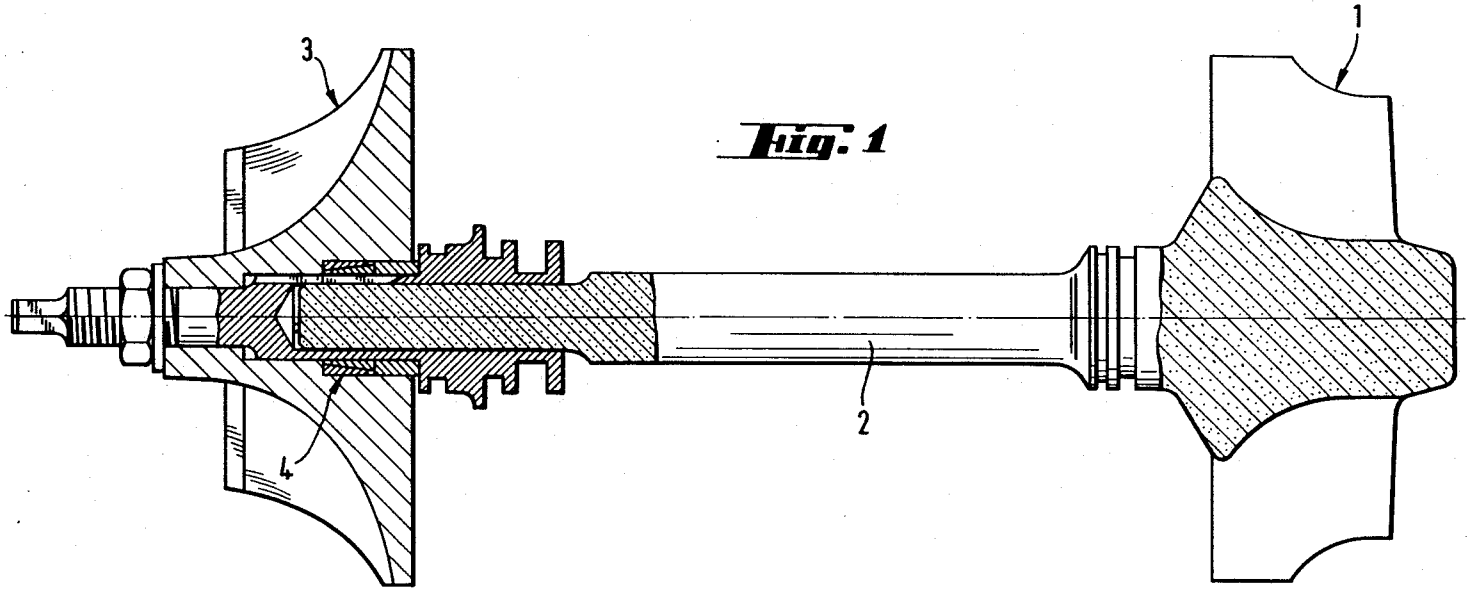
FIG. 1 shows the runner according to the invention, partially sectioned.

In the drawings, the runner of FIG. 1 consists of a radial turbine ceramic rotor 1 with integrated ceramic shaft 2 and a non-ceramic compressor impeller 3 which is rotationally firmly connected to the ceramic shaft 2 by means of a releasable mechanical coupling 4. In this connection, the releasable mechanical coupling 4 is located within the compressor impeller 3. Such a compressor impeller 3 is preferably manufactured from a metallic material, in particular, aluminium.

Figure 2:
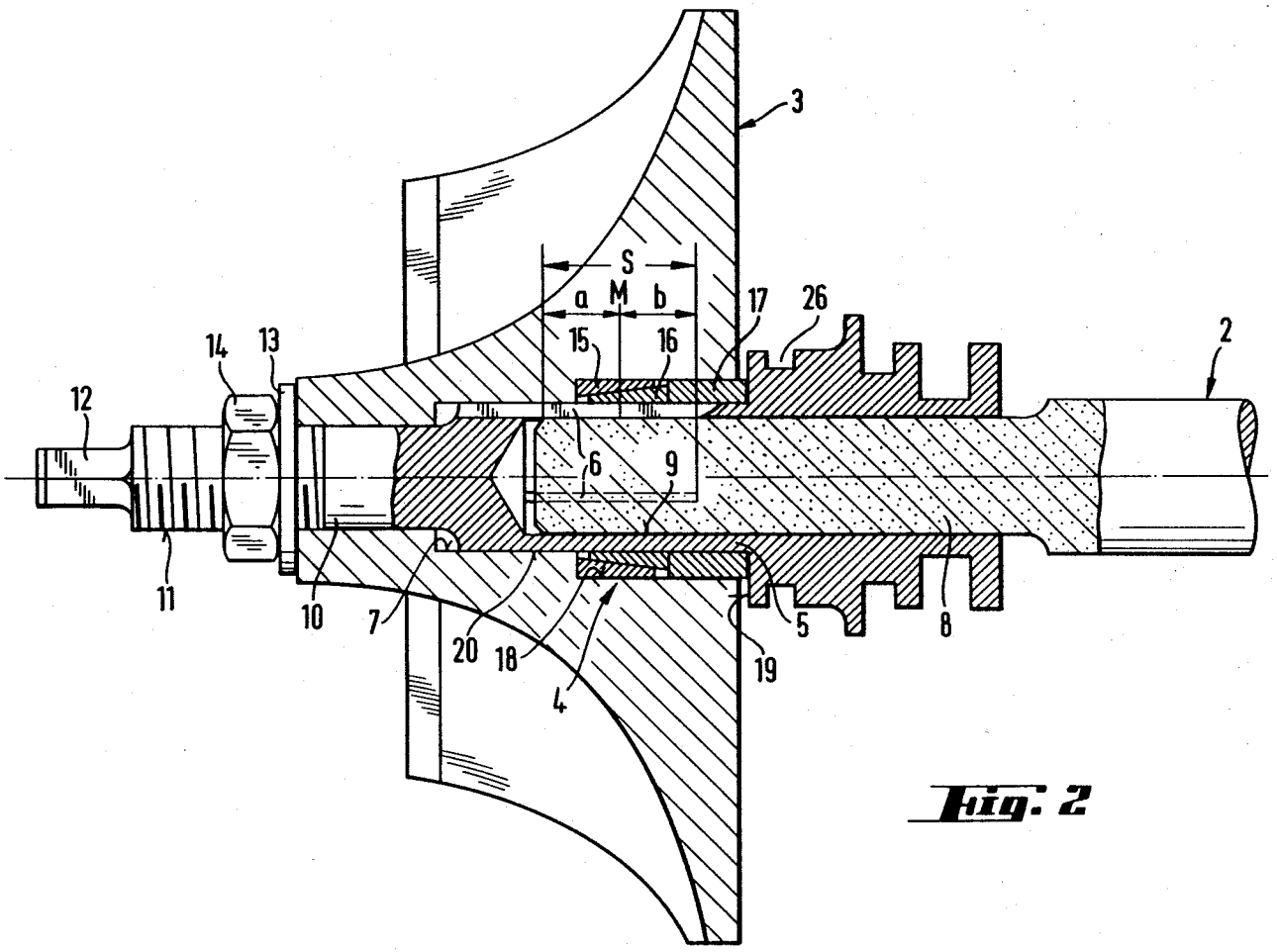
FIG. 2 shows an enlarged cross-section showing the left-hand region of FIG. 1 of the first embodiment.

FIG. 2 shows, in enlarged and detailed form, how the coupling 4 is constructed. It has a sleeve 5 which preferably contains three longitudinal slots 6. By this means, the diameter of the sleeve 5 can be slightly varied in the clamping region S. The cylindrical clamping surface 20 of the sleeve 5 is introduced into the cylindrical fitting bore 7 of the compressor impeller 3 and is there fixed. For this purpose, the compressor impeller 3 has a concentric extension to the fitting bore 7 in the form of a cylindrical acceptance bore 18. A pair of slotted conical clamping elements 15 and 16 are introduced into this acceptance bore 18. A cylindrical distance ring 17 is located between the clamping collar 19, the sleeve 5 and the conical clamping elements 15 and 16.

At its free end, the sleeve 5 has a tie rod 10 on which there is a screw thread 11. This tie rod 10 ends in square or hexagonal wrench flats. The complete assembly can now be clamped together between a washer 13 and the collar 19 by means of a nut 14 and the square 12. The slotted conical clamping elements 15 and 16 then slide over one another in their conical region so that an increase occurs in the diameter of the conical clamping element 15 and a decrease occurs in the diameter of the conical clamping element 16. In consequence, the fitting spigot 8 (which is introduced into the fitting bore 9 of the sleeve 5) is frictionally connected, in its clamping region S, to the compressor impeller 3. The assembly can be released again without difficulty, if required, by rotating the square 12 and the nut 14 appropriately relative to one another.

It is useful for the center M of the clamping region S to coincide with the effective center of the conical clamping element 15 and 16, i.e., for the distances a+b to be equal.

Figure 3:
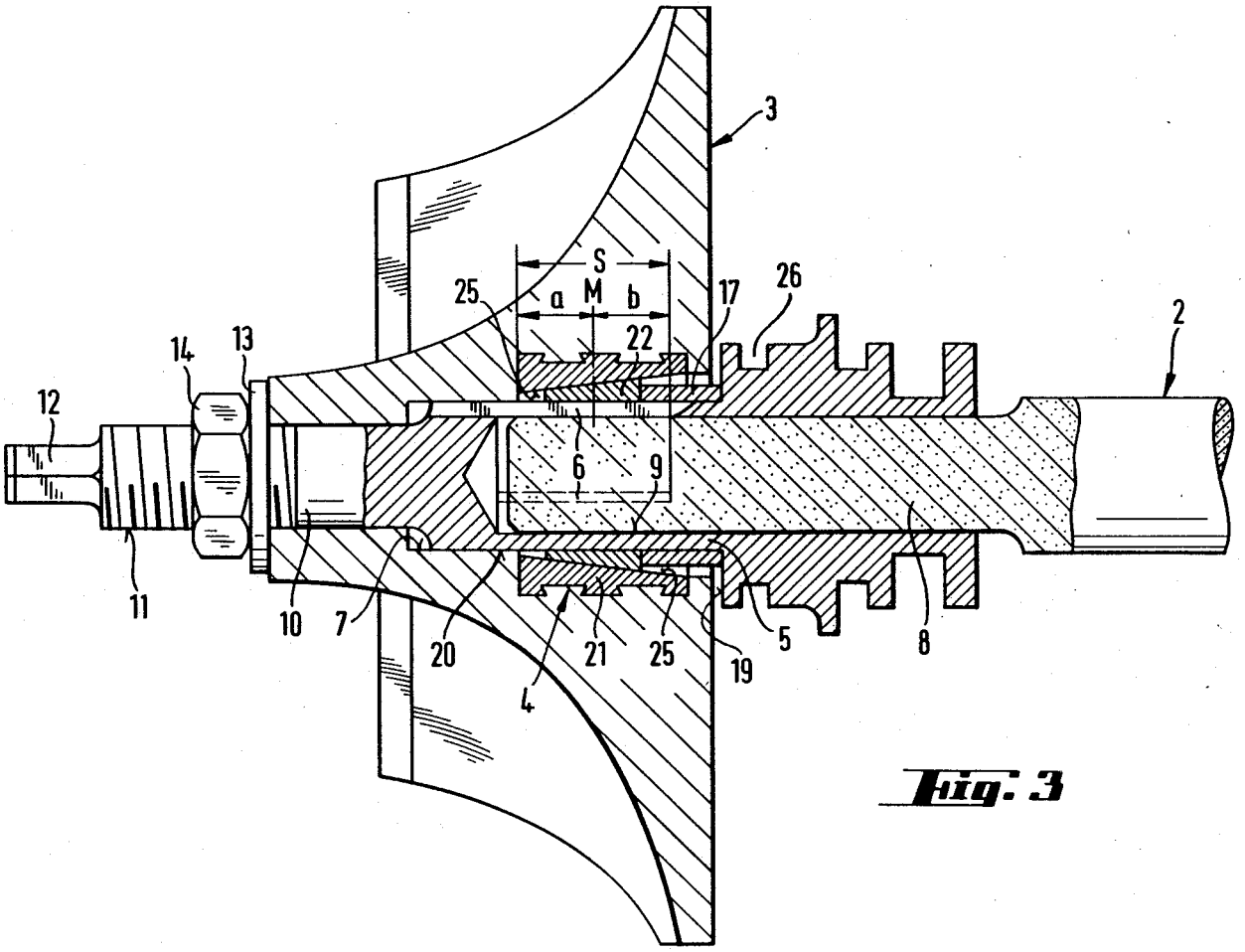
FIG. 3 shows a representation, corresponding to FIG. 2, showing a second embodiment form.

FIG. 3 shows a further embodiment with a design in which a hardened metallic bush 21 is cast into the compressor impeller 3. This bush has a ground conical clamping surface 25 which matches and clamps a slotted conical clamping element 22. All the other details of this second embodiment correspond to the first embodiment according to FIGS. 1 and 2.

Figure 4:
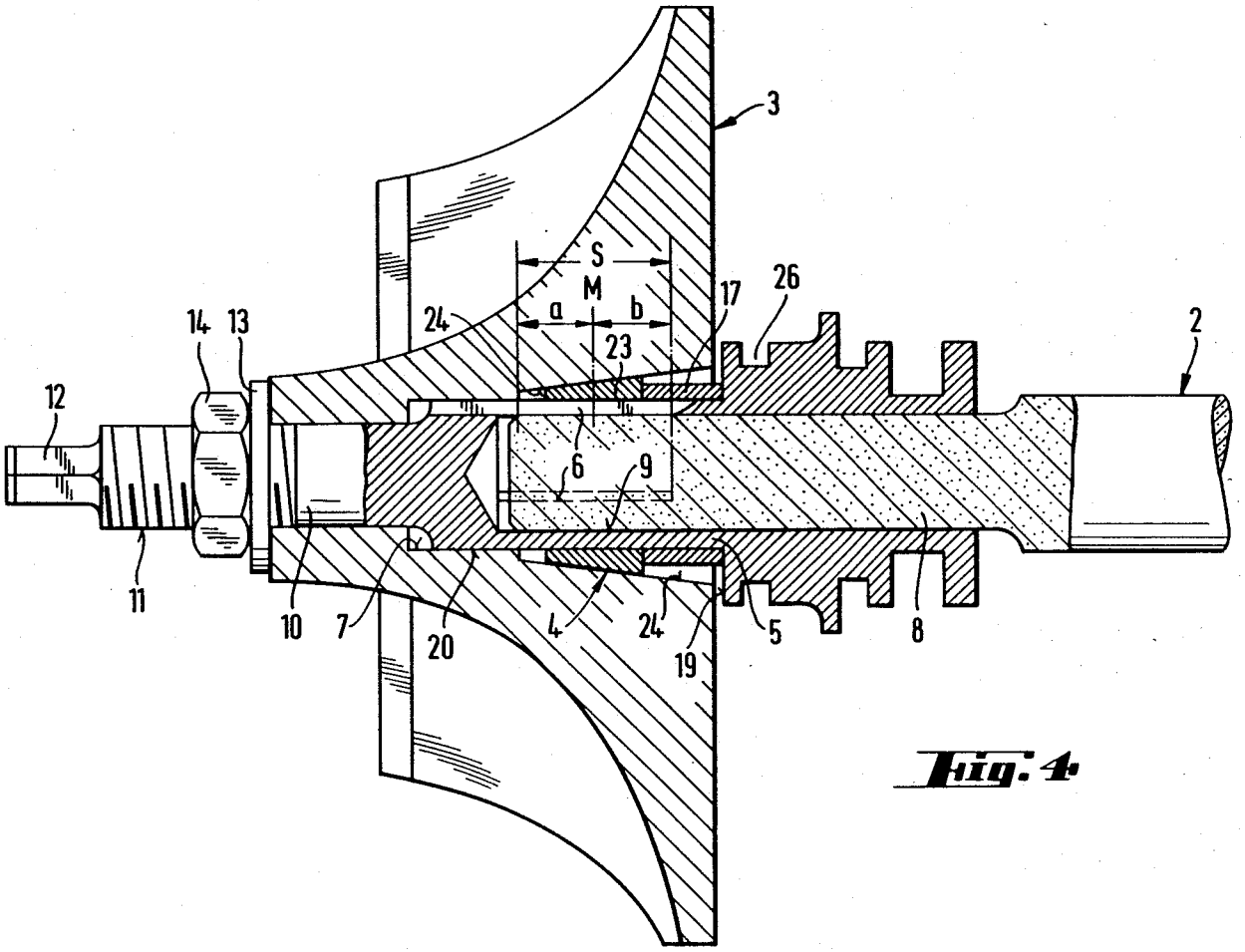
FIG. 4 shows a representation corresponding to FIGS. 2 and 3, showing a third embodiment form.

FIG. 4 shows a third embodiment in which the conical region is located directly in the compressor impeller 3 in the form of a conical bore 24. Here again, a single conical slotted clamping element 23 is sufficient. All the other details correspond to those of FIGS. 2 and 3.

Figure 5:
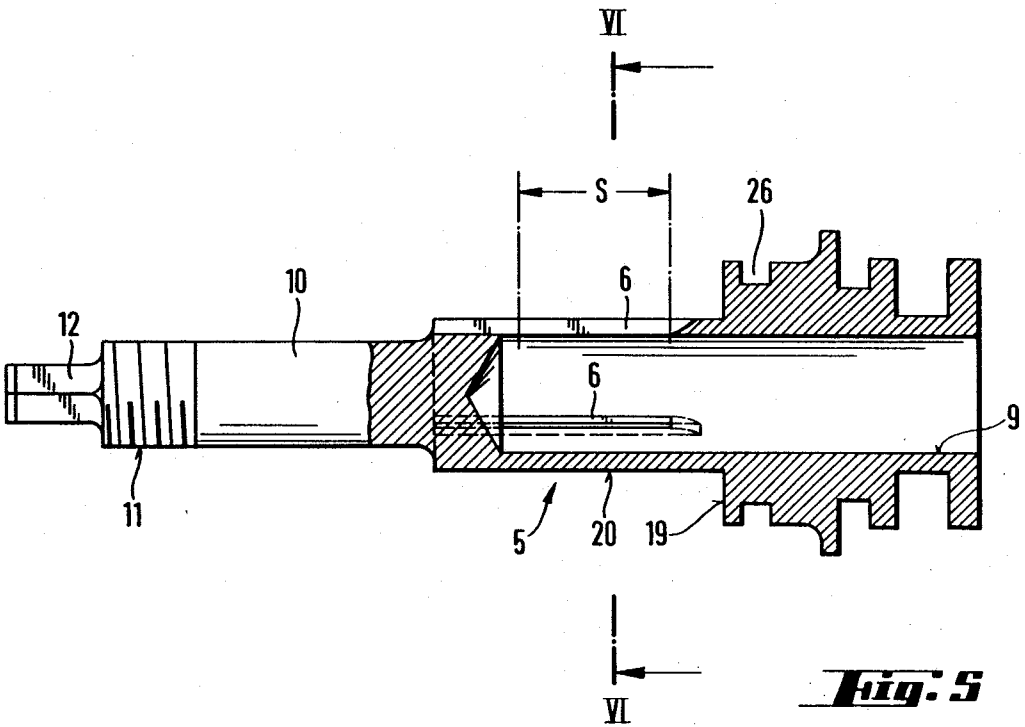
FIG. 5 shows a slotted sleeve in a partially sectioned view.
Figure 6:
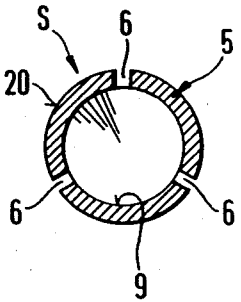
FIG. 6 shows a vertical section through FIG. 5 in the plane VI—VI of FIG. 5.

FIGS. 5 and 6 show, in longitudinal section and cross-section, the slotted sleeve represented in the embodiments of FIGS. 1, 2, 3 and 4. There are preferably three slots 6 located in the clamping region S. Alternatively, two or more than three slots can be provided.

On its end opposite to the square 12, the sleeve 5 has various devices of known type, e.g., a groove 26 for accepting a seal.

As indicated, the runner with mechanical coupling of the present invention is useful in the manufacture of vehicles, and in particular, those utilizing gas turbine and exhaust gas turbocharger rotors.

What is claimed is:

1. A runner consisting of a radial turbine ceramic rotor (1) with an integrated ceramic shaft (2) and a non-ceramic compressor impeller (3) which is rotationally firmly connected to the ceramic shaft (2) by a releasable, mechanical coupling (4) in such a way that the releasable mechanical coupling (4) is located within the compressor impeller (3) and wherein coupling (4) consists of a cylindrical slotted sleeve (5) which, on the one hand, is fitted into a cylindrical fitting bore (7) in the compressor impeller (3) and, on the other, accepts the end (8) of the ceramic shaft (2) in a fitting bore (9), of a tie rod (10) with a screw thread (11) and conical clamping means between the cylindrical sleeve (5) and the compressor impeller (3).

2. A runner as claimed in claim 1, wherein the conical clamping means pair of conical clamping elements (15, 16) is located by a distance ring (17) in the central clamping region S (a=b).

3. A runner as claimed in claim 1, wherein the runner has as conical clamping means a conical clamping element (22) which matches a conical bush (21) cast into the compressor impeller (3).

4. A runner as claimed in claim 1, having as conical clamping means a conical clamping element (23) which matches directly with a conical bore (24) in the compressor impeller (3).

* * * * *